US005078282A

United States Patent [19]

Stanfield

[11] Patent Number: 5,078,282

[45] Date of Patent: Jan. 7, 1992

[54] CUP RACK

[76] Inventor: John Stanfield, 425 Riverhill Dr., Atlanta, Ga. 30328

[21] Appl. No.: 568,514

[22] Filed: Aug. 16, 1990

Related U.S. Application Data

[63] Continuation-in-part of Ser. No. 443,183, Nov. 30, 1989, abandoned.

[51] Int. Cl.[5] ..... A47F 3/14

[52] U.S. Cl. ..... 211/126; 206/511; 206/512; 211/194

[58] Field of Search ..... 206/501, 508, 509, 511, 206/512, 144, 162, 203, 427, 428; 211/126, 194, 71, 59.4; 224/210, 209, 250, 257, 259, 261, 270; 220/21; 294/159, 161, 162, 163

[56] References Cited

U.S. PATENT DOCUMENTS

| | | | |
|---|---|---|---|
| Re. 16,335 | 4/1926 | Levene | 206/509 |
| 1,640,084 | 8/1927 | Leicht, Jr. | 211/126 X |
| 2,399,893 | 5/1946 | Scholz | 294/163 X |
| 3,283,915 | 11/1966 | Maslow | 211/126 |
| 3,376,046 | 4/1968 | Kivett et al. | 206/508 X |
| 3,412,893 | 11/1968 | Slapnik | 206/512 |
| 3,419,184 | 12/1968 | Asenbauer | 206/508 |
| 3,520,468 | 7/1970 | Wiemann | 206/508 |
| 3,544,021 | 12/1970 | Wilson | 206/511 X |
| 3,791,549 | 2/1974 | Delbrouck et al. | 206/509 X |
| 4,105,117 | 8/1978 | Atkin et al. | 206/501 |
| 4,120,444 | 10/1978 | Gray | 206/511 X |
| 4,247,004 | 1/1981 | Bird | 206/509 |
| 4,593,816 | 6/1986 | Langenbeck | 206/508 X |
| 4,694,961 | 9/1987 | Menendez | 206/508 |
| 4,911,303 | 3/1990 | Anderson | 206/511 X |

FOREIGN PATENT DOCUMENTS

| | | | |
|---|---|---|---|
| 0384143 | 10/1923 | Fed. Rep. of Germany | 211/126 |
| 0466224 | 5/1937 | United Kingdom | 294/159 |

*Primary Examiner*—Carl D. Friedman
*Assistant Examiner*—Korie H. Chan
*Attorney, Agent, or Firm*—Kennedy & Kennedy

[57] ABSTRACT

A cup rack for transporting, washing, and storing cups or glasses has a frame with open ended receptacles with support members in the bottom thereof for receiving cups or glasses. The support members have projections for locating and holding the cups or glasses. Guides at the corners of the frame are adapted to locate a cover member and a superposed rack nesting therein.

3 Claims, 3 Drawing Sheets

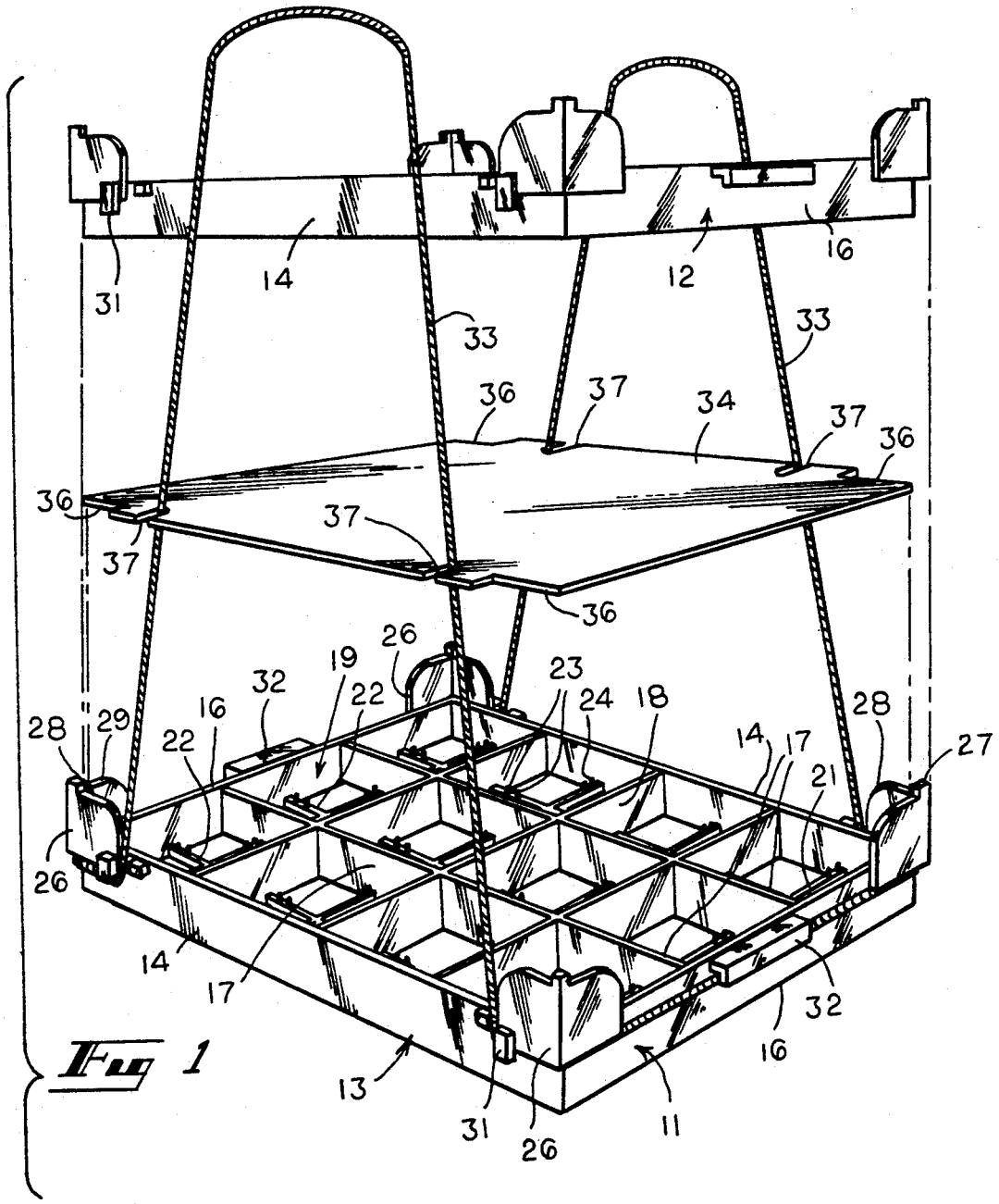
Fig 1
Fig 4
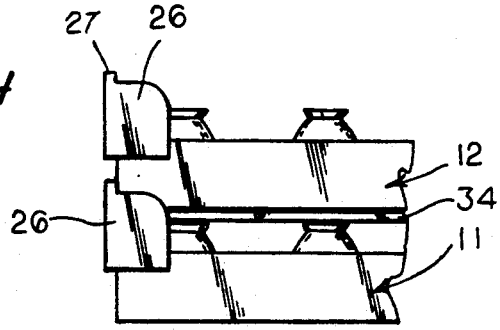
Fig 3
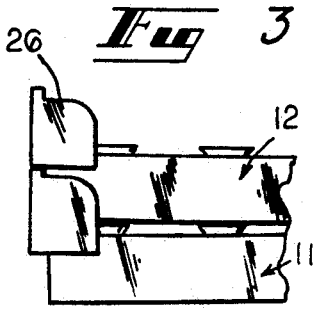

CUP RACK

This is a continuation-in-part of application Ser. No. 443,183 filed Nov. 30, 1989, now abandoned.

TECHNICAL FIELD

This invention relates to racks for use in carrying and storing tableware such as cups, glasses and the like.

BACKGROUND OF THE INVENTION

It is common in the restaurant, tableware rental, food catering, and moving industries for large numbers of cups or glasses to be racked, washed and stacked for economy of storage space and handling efficiency. Considerable difficulty can be encountered in handling racks of relatively fragile cups or glasses inasmuch as such racks are often cumbersome to handle, hence if the racks are shaken or improperly stored, breakage of the cups or glasses can and often does occur. Additionally, after the tableware has been washed, further handling thereof is unsanitary. Thus it is desirable that glasses or cups be subjected to a minimum of handling, so that, once placed in a rack, they remain there until used again, and that the racks themselves be subjected to as little handling as possible.

In U.S. Pat. No. 3,367,529 of Welch et al there is shown an arrangement that exemplifies the prior art. That patent discloses a bus box for carrying a dishwasher rack containing a set of glasses. It is necessary to remove the rack from the box for washing the glasses, and also to remove the rack from the box for stacking, if indeed the racks are stackable. Otherwise the glasses must be removed from the rack for storing, which is unsanitary and often leads to breakage. It can be appreciated that the Welch et al arrangement does little to minimize handling of the glasses and of the rack.

There are other types of racks shown in the prior art, some for use as dishwasher racks, and some for use as storage racks, but not both. Further, as in Welch et al, most such racks require some means, such as a carrying box, for transport.

Accordingly, it is seen that a need exists for a rack into which soiled cups, glasses and the like may be placed, washed, and stored without removal from the rack until usage, thereby minimizing breakage and unsanitary handling. It is to the provision of such a rack that the present invention is primarily directed.

SUMMARY OF THE INVENTION

The present invention is a lightweight, versatile cup rack for use in transporting, washing, and storing a set of cups, glasses or the like which herein are collectively referred to as cups in the specification and claims for conciseness of narration. In a preferred embodiment, the rack comprises a frame member having intersecting divider members that define a plurality of open ended receptacles for receiving and holding cups. A plurality of intersecting rib members extend from a lower portion of the interior of the sides of the frame and intersect approximately centrally within each receptacle for supporting the cups thereon. Each of the rib members has projections that extend upwardly for restricting the movement of the cup supported thereon. Guide members mounted at each corner of the frame and extending upwardly therefrom are provided to receive the corners of the frame of a second rack of the same construction stacked upon the first rack. The guide members have bearing surfaces to enable a second rack to slide above the lower rack until oriented in a nesting position relative to the lower rack. When nested, the ribs of the upper rack may rest upon the bottoms of the inverted cups or glasses in the first rack, thereby holding them firmly in place within their receptacles.

Each of the guide members has a downwardly extending tang spaced from a side wall of the frame to form a slot in conjunction with the side wall, and first and second carrying brackets are mounted to the external upper portion of first and second opposed side walls of the frame. An endless carrying member is adapted to fit within the slots and the carrying brackets for carrying the rack.

A top cover member may be provided for resting on the bottom of inverted cups held in the rack. The cover is sized to fit within the guide means for positive location. The cover dimensions are such that it extends over the side walls of the frame. The cover, when in place over the cups or glasses, is thus adapted to receive and bear the weight of a superposed nested rack, thereby holding the cups in the lower rack firmly in place. The cover also presents a sliding surface with guide ribs for the frame of the upper rack, permitting it to be guidedly slid into a nesting position.

BRIEF DESCRIPTION OF THE DRAWING

FIG. 1 is an exploded view, in perspective, of a preferred embodiment of a pair of cup racks of the present invention.

FIG. 3 is a partial, side elevation view of a nested pair of racks.

FIG. 4 is a partial side elevation view of a nested pair of racks utilizing a cover member.

DETAILED DESCRIPTION

Figure 2:
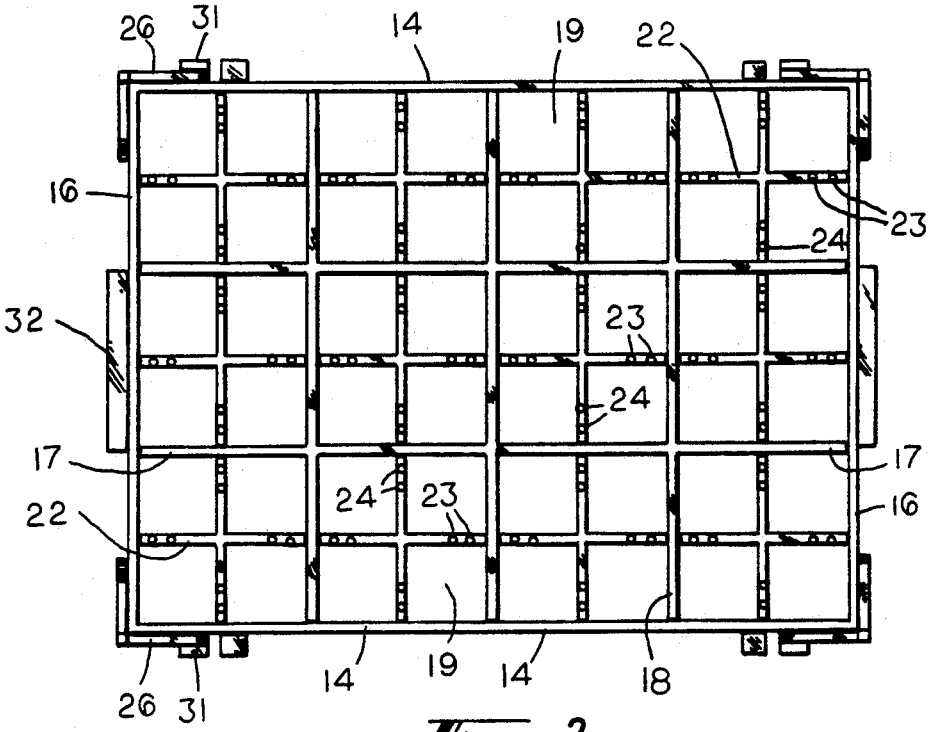
FIG. 2 is a plan view of one of the cup racks of FIG. 1.

Referring now in more detail to the drawings, in which like reference numbers indicate like parts throughout the several views, FIG. 1 shows first and second racks 11 and 12 of the same construction. Rack 11 comprises a frame 13 having two side walls 14 and two end walls 16. Extending between end walls 16 are two divider members 17 and extending between side walls 14 are three other divider members 18 which intersect with members 17 to form a plurality of open top compartments or receptacles 19. The divider members may be formed as a single unitary structure, or as a plurality of slotted members whose slots mate to form the compartmentalized structure shown best in FIG. 1.

Extending from the lower portion of one wall 14 to the lower portion of the other wall 14 are a plurality of ribs 21 which preferably are continuous and pass through slots in members 17. In like manner, a plurality of ribs 22 extend from the lower portion of one wall 16 to the lower portion of the other wall 16, and intersect members 21 to form a grid structure, as best seen in FIG. 2. The location of member 21 on walls 14 and of members 22 on walls 16 is such that the intersections of members 21 and 22 occur substantially centrally of each of the compartments 19 at the lower ends thereof to form supports for the cups to be racked. As was the case with members 17 and 18, the grid structure formed by members 21 and 22 may be formed as a single unitary structure fitted into notches in the bottom of members 17 and 18, or the members 21 and 22 may be individual ribs having mating notches at the intersection points.

Each of the ribs 21 has a plurality of upwardly extending spaced projections 23 and each of the ribs 22 has a plurality of upwardly extending spaced projections 24. Projections 23 and 24 are located on the ribs 21 and 22 such that two pairs of such projections are located within the confines of each receptacle 19 in proximity to the side walls thereof, as best seen in FIG. 2. Projections 23 and 24 help locate the rims of undersized glasses or cups and restrain them from movement. Thus the receptacle 19 in conjunction with ribs 21 and 22 and projections 23 and 24 can accommodate and support various sizes of cups in an inverted position while at least partially restraining them from movement within the receptacle.

As thus far described, FIGS. 1 and 2 depict a lightweight rack 11 having a plurality of open ended receptacles 19 for receiving glasses or cups which are supported within the receptacle by intersecting ribs 21 and 22. The cups, which are placed in the receptacles in an inverted position, are prevented from moving around therein by a plurality of projections 23 and 24. Such a structure, which is made of heat resistant material, when placed in a dish washer, permits substantially complete drainage of the water and soiling matter as a result of the open structure.

At each corner of the rack 11 are mounted guide members 26, 26, which extend upwardly from rack 11. Each guide member 26 has, at the top thereof, a projection 27 and bearing surfaces 28 and 29. The projections 27 and the surfaces 28 and 29 are adapted to receive and locate a second rack 12 to assist in the stacking of the racks, in a manner which will be explained more fully in connection with FIGS. 5A through 5D. Each of the guide members also has a downwardly extending tang 31 which is spaced from side walls 14 to form open slots therewith, and a pair of L-shaped brackets 32 are mounted centrally of side members 16 with their openings facing down, thereby forming open ended slots with members 16. As shown in FIG. 1 the slots thus formed by tangs 31 and brackets 32 are adapted to receive a flexible, endless carrying member 33 which may be a rope or other suitable flexible member. Member 33 permits transport of a single rack 11, or a plurality of stacked racks, it only being necessary for the member 33 to engage the slots on the bottom rack of the stack. FIG. 3 depicts a pair of stacked racks 11 and 12 and it can be seen that rack 12 nests within and is held in place by members 26, and rests upon the bottoms of the inverted cups or glasses in the lower rack 11.

In one embodiment of the invention, a planar cover member 34 is interposed between stacked racks 11 and 12 as shown in FIG. 4. The corners of member 34 have cut out portions 36 so that member 34 may be nested within guide members 26 and rest upon the bottoms of the inverted cups or glasses. The lateral dimensions of member 34 are such that, when nested, it extends over and beyond the side walls 14 and 16, and slots 37 are provided to prevent interference with flexible carrying member 33. Member 34, in addition to its function to be described in connection with FIGS. 5A through 5D, and its load bearing function, also functions to protect the cups or glasses in the rack from contamination. Thus, where the cups are to be stored for extended periods of time, it may be desirable to hermetically seal them. This can be done by placing a rack 11 and cover 34, or a plurality of racks and covers upon a sheet of plastic cling film. The film is then pulled up around the racks and secured to the topmost cover 34. The top covers in the stack prevent the film from contacting the cups inside the racks, thus preventing contamination and spotting of the glassware.

Figure 5A:
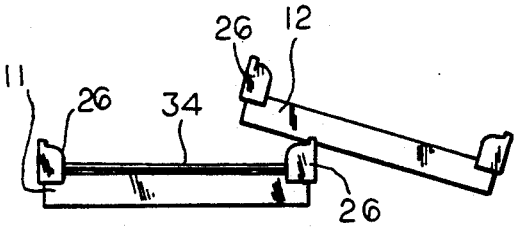
FIGS. 5A through 5D depict, in plan view, various steps in positioning one rack for nesting above a second rack.
Figure 5B:
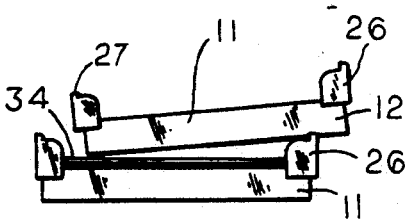
Figure 5C:
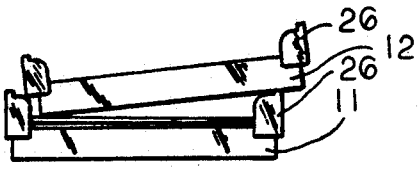
Figure 5D:
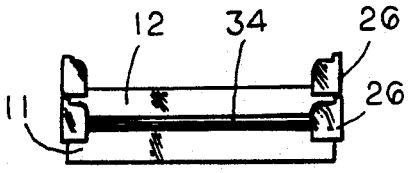

FIGS. 5A through 5D illustrate the sequence of steps involved in stacking a rack 12 on top of a rack 11 with member 34 in place, in a situation where rack 11 is located on a shelf or in a stack too high for the operator simply to lift rack 12 and place it down upon rack 11. As seen in FIG. 5A, rack 12 is placed upon bearing surfaces 29 between two projections 27 and slid therealong until it tilts downward and comes to rest on the top of member 34. It is then slid forward until it comes to rest in its nested position, as shown in FIG. 5D. Conversely, to remove an upper rack one merely grasps a bracket 32, lifts and pulls it whereupon the forward end of the upper rack slides upon the member 34 and the nearer bearing surface until removed. In the absence of member 34, it would be difficult to move rack 12 to its nested position inasmuch as the cups or glasses would impede the sliding of rack 12. However, as shown in FIG. 5C, rack 12 may be slid along bearing surfaces 29 until it reaches its nesting position.

Figure 6:
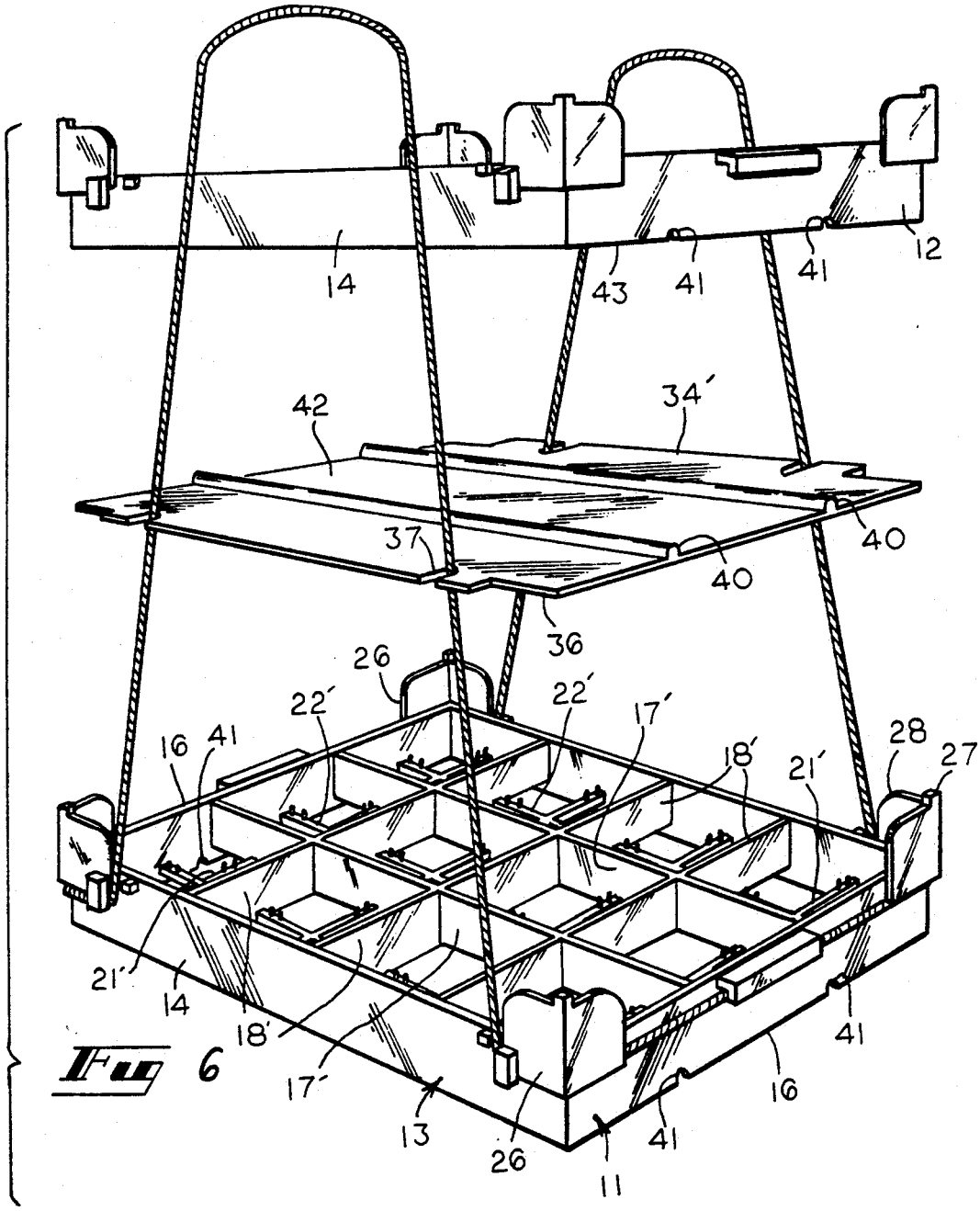
FIG. 6 is an exploded view, in perspective, of another preferred embodiment of a pair of cup racks of the present invention together with a cover in an alternative form.
Figure 7:
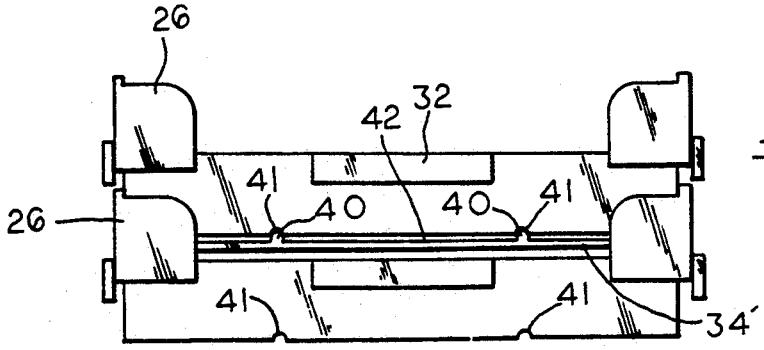
FIG. 7 is a front elevation view of a nested pair of the racks of FIG. 6 and modified cover.

In the alternative embodiment shown in FIGS. 6 and 7 the cover member 34' has a top surface 42 with two parallel guide ribs or rails 40. Here the two end walls 16 have guide notches 41 in the rack bottom edge 43 which are sized and configured to slidably receive the guide ribs 40, to assure that the top rack 12 is guided to its nesting position. The guide ribs are configured so that the rack bottom edge 43 does not contact the cover member 34, thereby preventing rack 12 from disturbing the plastic cling film secured to the topmost cover while being slid or in a nested position as shown in FIG. 7. In this embodiment the dividers 17', and 18' and ribs 21' and 22' are spaced from the plane of the rack bottom edge 43 to provide clearance for the guide ribs.

It can be seen from the foregoing that a rack is provided which overcomes problems and limitations of the prior art arrangements. Although the invention has been described in two preferred embodiments thereof, numerous modifications, additions and/or deletions may be made thereto without departure from the spirit and scope of the invention as set forth in the following claims.

I claim:

1. A cup rack comprising a frame having a pair of end walls and a pair of side walls which intersect to form frame corners and with said end walls having a notch formed in the bottom edge thereof; a plurality of cup support members mounted within said frame for supporting and maintaining cups in generally fixed positions relative to one another; a corner guide mounted about and projecting above each of said frame corners, and with each of said corner guides having a guide side wall mounted to and projecting above said frame side wall and having an upper bearing surface, and with each of said guides having a guide end wall mounted to and projecting above said frame end wall; and a cover configured to fit upon said frame within said corner guides and having at least one guide rib on an upper surface thereof, whereby the frame of an other cup rack of substantially the same construction may be nested upon the cup rack by sliding the other frame upon the corner guides end walls with the cover guide rib sliding within the frame wall notch of the other frame and bringing the guide side walls of both racks into mutual camming engagement camming them into positions one atop the other and with the other rack frame nested within said corner guides.

2. The cup rack of claim 1 wherein each of said corner guides has an upwardly extending projection at the junction of the guide side and end walls.

3. The cup rack of claim 1 wherein the upper edge of said guide side wall bearing surfaces are rounded.

* * * * *